United States Patent [19]

Barham et al.

[11] 4,244,268

[45] Jan. 13, 1981

[54] STRIKE LINE ADJUSTER

[75] Inventors: Jairus P. Barham, Spring Lake; Norman L. Meyer, Grand Haven, both of Mich.

[73] Assignee: Norlin Industries, Inc., Deerfield, Ill.

[21] Appl. No.: 38,791

[22] Filed: May 14, 1979

[51] Int. Cl.[3] ..... G10C 3/00

[52] U.S. Cl. ..... 84/432

[58] Field of Search ..... 84/430, 432, 439, 447

[56] References Cited

U.S. PATENT DOCUMENTS

| | | | |
|---|---|---|---|
| 32,654 | 6/1861 | Sheldon | 84/447 |
| 480,014 | 8/1892 | Hawes | 84/432 |
| 733,725 | 7/1903 | Mallebre | 84/432 |
| 1,699,465 | 1/1929 | Edward | 84/432 |

*Primary Examiner*—Lawrence R. Franklin
*Attorney, Agent, or Firm*—Jack Kail; Ronald J. Kransdorf

[57] ABSTRACT

A hammer strike line adjuster for use with a grand piano comprises a metallic, generally U-shaped bracket, a worm gear rotatably received within a pair of aligned apertures formed in the side walls of the bracket and a shift pin having a first end secured to the piano key frame assembly and a second end engaging an annular recessed portion of the worm gear for movement together therewith. The apparatus, which is disposed between the piano key frame assembly and treble arm and underlying the piano key block, is operative for accurately adjusting the position of the piano hammer strike line in response to rotation of the worm gear.

3 Claims, 5 Drawing Figures

FIG. 3
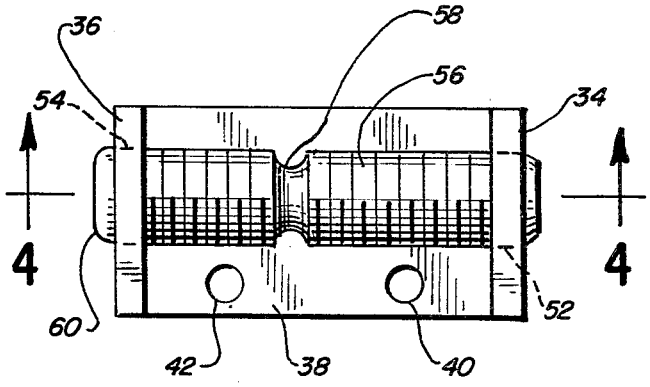
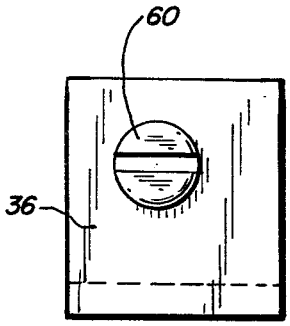
FIG. 5
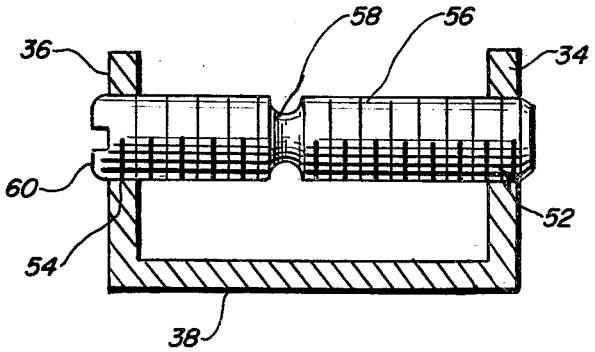
FIG. 4

STRIKE LINE ADJUSTER

BACKGROUND OF THE INVENTION

The present invention relates to grand pianos and, more particularly, to apparatus useful in association with such pianos for adjusting the hammer strike line in relation to the piano strings.

A grand piano conventionally comprises a plurality of keys each operatively connected through a suitable action mechanism to a hammer disposed for striking a respective piano string in response to depression of the associated key. It is known that the precise points along the strings which are struck by the hammers, collectively defining the hammer strike line, upon the playing of the keys are critical to the production of brilliant and properly sounding notes. In this regard, the strike points of the strings forming the treble end of the keyboard are of particular concern in that these relatively short length strings are highly sensitive to changes in hammer strike points. Thus, a very small change in the strike point of a treble string, say, for example, about one-third of a centimeter, can result in a significant detuning of the string. Such strike point changes may result from, inter alia, environmental conditions, such as humidity and the like, which cause portions of the action mechanism or hammer to expand or contract and thereby alter the string strike points. While the sounds produced by the longer length bass strings are not affected as extremely as are the treble strings by changes in strike points, they too may nevertheless produce a less than optimum sound especially if a rather large change is experienced.

In the past, strike line adjustments have been largely effected on a trial and error basis wherein a technician physically adjusts the position of the piano key frame assembly, which assembly carries all of the keys together with their associated action mechanisms and hammers, while simultaneously listening to the sound produced by the highest pitched note on the keyboard. Upon properly establishing the strike point for this latter note, it is then assumed that the strike points of the remaining strings have also been properly established.

In order to facilitate the foregoing, various devices have been proposed to aid the technician in making the slight longitudinal adjustments in the position of the key frame assembly necessary to optimumly set the strike line for obtaining the best sound from the high treble portion of the keyboard. These prior art devices typically include an adjustment screw journalled through the piano key block disposed adjacent the treble end of the keyboard for operating a member receiving a suitable key frame shift pin. The key frame shift pin is rigidly secured to the key frame assembly such that operation of the adjustment screw is effective for longitudinally shifting the position of the key frame assembly to set the strike line as desired.

As noted above, the prior art adjustment screw is journalled through the piano key block such that its operative end is exposed for conveniently allowing adjustments to be made without requiring any disassembly of the piano. Although this feature is desirable when exercised by a properly trained technician, it is also subject to certain abuses from the untrained layman. In particular, either intentional or inadvertent operation of the adjustment screw by an untrained layman may result in the hammer strike line being moved to an extent totally degrading the sound normally produced by the piano. In addition, the key block itself being comprised of wood is subject to various environmental conditions which may warp or otherwise alter the characteristics of the assembly. This would, in turn, slightly change the position of the key frame shift pin and thereby adversely affect the previously established hammer strike line. Also, repeated operation of the adjustment screw tends to adversely affect the nature of the key block channel through which the screw passes. Thus, after repeated use, the adjustment screw may begin to slightly slip within the key block channel making it difficult to effect a desired adjustment as well as difficult to securely maintain a previously set adjustment.

SUMMARY OF THE INVENTION

It is therefore a basic object of the present invention to provide a new and improved hammer strike line adjustment apparatus for use with a grand piano.

It is a more particular object of the invention to provide a hammer strike line adjustment apparatus for use in association with a grand piano which is largely tamper-proof and which is characterized for achieving a high degree of positional accuracy regardless of environmental conditions.

In accordance with these and other useful objects the strike line adjustment apparatus of the present invention comprises a generally U-shaped metallic bracket securely fastened to the keyboard of the piano intermediate the key frame assembly and piano treble arm. The bracket includes two aligned apertures formed in its upstanding side walls for receiving an externally threaded worm gear which is operative for movement within the bracket longitudinally of the key frame assembly. The worm gear includes an annular recessed portion for engaging one end of a laterally extending shift pin, the other end of the shift pin being securely fastened to the key frame assembly. The entire structure including the bracket, the worm gear and the shift pin is unaccessibly disposed within a hollowed out portion of the pinao key block adjacent the treble arm of the piano cabinet. To effect operation of the adjustment apparatus, the piano key block is initially removed to expose the apparatus. A suitable implement, such as a screwdriver or the like, is then used to rotate the worm gear within the bracket for movement longitudinally of the key frame. As a result, the lateral shift pin is also longitudinally moved carrying with it the key frame assembly. The position of the key frame assembly may thereby be adjusted to establish a desired strike line. Preferably, the strike line is established by adjusting the position of the key frame assembly to obtain the most brilliant sound from the highest pitched note on the keyboard.

BRIEF DESCRIPTION OF THE DRAWINGS

FIG. 3 is a top plan view of the hammer strike line adjustment apparatus of the present invention.

FIG. 4 is a cross-sectional view of the hammer strike line adjustment apparatus of the invention taken along line 4—4 of FIG. 3.

FIG. 5 is a front elevational view of the hammer strike line adjustment apparatus of the invention.

DESCRIPTION OF THE PREFERRED EMBODIMENT

Figure 1:
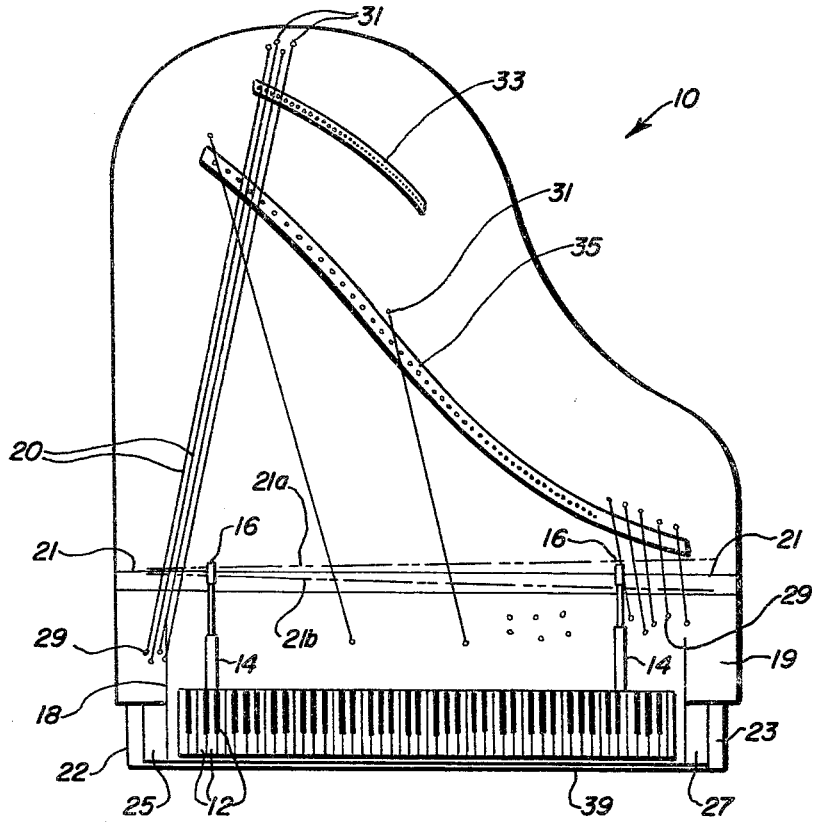
FIG. 1 is a top plan view, in schematic form, of a grand piano useful for explaining the utility of the hammer strike line adjustment apparatus of the invention.

Referring now to the drawings and, in particular, to FIG. 1, a conventional grand piano 10 comprises a cabinet assembly carrying a plurality of keys 12, each key 12 being connected through a respective action mechanism 14 to a hammer 16. For purposes of clarity, only two action mechanisms 14 and their associated hammers 16 are shown in the illustration. The keys 12 and actions 14 are all disposed overlying and secured to a key frame assembly 18 which, in turn, is carried on a keybed 19. A pair of key blocks 25 and 27 are also secured to the keybed 19 intermediate either end of key frame assembly 18 and the piano bass and treble arms 22 and 23. Primarily for aesthetic purposes, a key slip 39 is typically mounted intermediate treble and bass arms 22 and 23 just in front of keyframe assembly 19 and key blocks 25 and 27.

The piano 10 further includes a plurality of longitudinally arranged strings 20 disposed overlying the hammers 16 and connected between spaced pins 29 and 31 located at either end of the piano. A bass bridge 33 and a treble bridge 35 are disposed near pins 31 for defining the active lengths of the strings 20. Upon depression of a key 12, the associated action mechanism 14 operates a hammer 16 for striking its associated string 20. The struck string 20 is, of course, set into mechanical vibration whereby a sound having a particular pitch is produced. The pitch of the sound produced depends largely upon the active length of string which is struck. Thus, the shorter strings located at the treble end of the keyboard produce a relatively high pitched sound whereas the longer strings disposed at the bass end of the keyboard produce a much lower pitched sound.

In addition to the length of string involved, the tonal qualities of the sound produced when striking a particular string are also dependent upon the precise point along the string which comes into contact with the hammer. This point is commonly referred to as the strike point of the string and the strike points of all the strings taken together is commonly referred to as the strike line of the piano. As previously discussed, the establishment of a proper strike line along the strings 20 is critical to the production of brilliantly sounding tones and the treble strings are much more sensitive to changes in strike points than are the bass strings. As will be discussed below, the apparatus of the present invention provides a convenient and accurate means for adjusting the strike line of the piano to an optimum setting.

Figure 2:
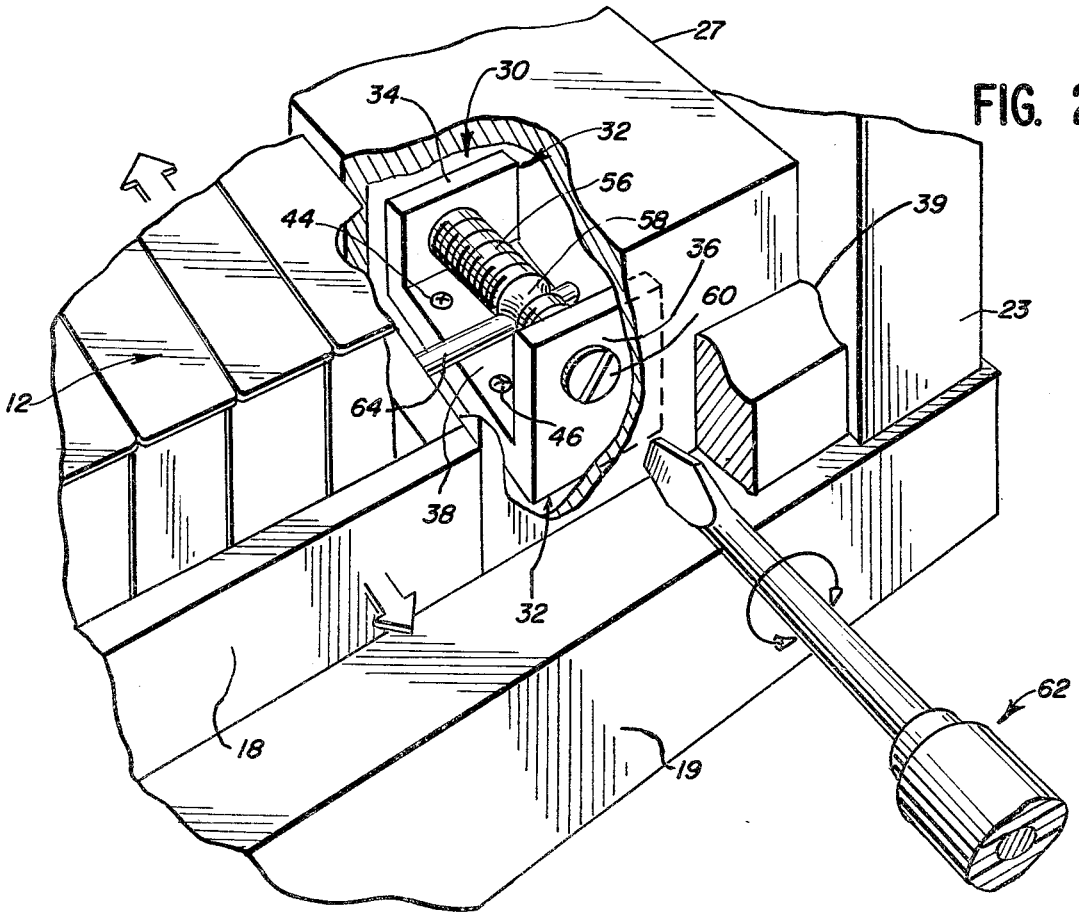
FIG. 2 is a perspective view illustrating a portion of a piano incorporating the hammer strike line adjustment apparatus of the present invention.

With reference to FIG. 2, the strike line adjustment apparatus of the present invention indicated generally by reference numeral 30, is disposed between key frame assembly 18 and treble arm 23 within a hollowed-out portion of block 27. More particularly, strike line adjustment apparatus 30, which is shown in detail in FIGS. 3–5, comprises a generally U-shaped metallic bracket 32 having a pair of opposed upstanding side walls 34 and 36 and a base member 38 extending transversely therebetween. Base member 38 includes a pair of longitudinally aligned apertures 40 and 42 offset from the central axes of bracket 32 toward key frame assembly 18 and adapted for receiving a pair of mounting screws 44 and 46. As clearly shown in FIG. 2, mounting screws 44 and 46 are received within apertures 40 and 42 for fastening bracket 32 of strike line adjustment apparatus 30 to the keybed 19 of piano 10 intermediate the key frame assembly 18 and treble arm 23. Bracket 32 is preferably constructed of aluminum although other suitable metallic substances may also be used.

Bracket 32 further includes a pair of axially aligned apertures 52 and 54 internally threaded for operatively receiving a longitudinally disposed worm gear 56 which preferably comprises a brass structure. Worm gear 56 is externally threaded for cooperating with the internal threads of apertures 52 and 54 and includes a recessed annular portion 58 devoid of any threads. Worm gear 56 further includes a head portion 60 adapted for facilitating rotation by a suitable implement such as a screwdriver generally indicated at 62. It will be appreciated that rotation of head 60 in one direction or the other will cause worm gear 56 to be longitudinally displaced within bracket 32 in a corresponding direction.

Strike line adjustment apparatus 30 further includes a laterally disposed shift pin 64 having one end securely fastened to the treble end of key frame assembly 18. The second end of shift pin 64 is engagingly received within the annular recess 58 of worm gear 56. As a result of this arrangement, longitudinal displacement of worm gear 56 within bracket 32 operates shift pin 64 for similarly displacing key frame assembly 18 together with the keys 12 and action mechanisms 14 carried thereon. In actuality, since the bass end of key frame assembly 18 is rigidly secured to the keybed 19, shift pin 64 is operative for pivotally adjusting the position of key frame assembly 18. This movement of key frame assembly 18, of course, affects the positional relationship between hammers 16 and strings 20 for adjusting the strike line of the piano.

For purposes of an exemplary showing, assume that the strike line of a piano is initially defined by the line 21 illustrated in FIG. 1. Adjustment of strike line 21 may then be effected by initially removing key block 27 which otherwise unaccessibly covers adjustment apparatus 30. Next, worm gear 56 is operated while simultaneously playing the highest pitched note on the piano keyboard until the most brilliant sound is produced. A new strike line 21*a* or 21*b* will thereby be established, which strike line is pivotally displaced from strike line 21 in a direction corresponding to the direction of rotation of worm gear 56. It will be observed that the foregoing adjustment primarily affects the treble strings and, in particular, the shortest treble string. It is assumed that if the strike point for this string is properly set, the strike points for the remaining strings will also be proper. Also, since the shorter piano strings are more sensitive than are the longer strings to changes in strike point positions and, therefore, the most likely to detune as well as the most difficult to properly set, setting the piano strike line according to the sound produced from the high treble end of the keyboard is considered to be the most optimum approach.

While a particular embodiment of the invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention.

What is claimed is:

1. In a piano of the type having a keyframe assembly overlying a keybed, an improved hammer strike line adjustment apparatus comprising:

a generally U-shaped bracket having a base and a pair of opposed side walls extending upwardly from the distal ends of said base, said side walls including a pair of axially aligned internally threaded apertures and said base being fastened to the piano keybed intermediate the keyframe assembly and treble arm so that the axis of said apertures extends longitudinally alongside the keyframe assembly;

an externally threaded worm gear cooperatively received by said apertures for movement longitudinally of the keyframe assembly in response to rotation thereof, said worm gear including an annular recessed portion;

a shift pin having a first end secured to the keyframe assembly and a second end received by the annular recessed portion of said worm gear, whereby rotation of said worm gear is effective for longitudinally displacing said shift pin for adjusting the hammer strike line characterizing said piano; and a piano keyblock securable between the keyframe assembly and treble arm for normally covering said bracket, worm gear and shift pin and being removable for effecting rotation of said worm gear.

2. The improvement according to claim 1 wherein said bracket is constructed of a metallic material.

3. The improvement according to claim 1 wherein said worm gear includes a head member extending beyond the outer surface of the forwardmost one of said side walls and adapted for facilitating rotation of said worm gear.

* * * * *